US006435919B1

(12) United States Patent
Saka et al.

(10) Patent No.: US 6,435,919 B1
(45) Date of Patent: Aug. 20, 2002

(54) CONNECTOR AND MOULD

(75) Inventors: Yukinori Saka; Masamitsu Chishima, both of Yokkaichi (JP)

(73) Assignee: Sumitomo Wiring Systems, Ltd., Mie (JP)

( * ) Notice: Subject to any disclaimer, the term of this patent is extended or adjusted under 35 U.S.C. 154(b) by 0 days.

(21) Appl. No.: 09/713,208

(22) Filed: Nov. 16, 2000

(30) Foreign Application Priority Data

Nov. 17, 1999 (JP) ..... 11-327095

(51) Int. Cl.[7] ..... H01R 13/436
(52) U.S. Cl. ..... 439/752
(58) Field of Search ..... 439/752, 595

(56) References Cited

U.S. PATENT DOCUMENTS 4,867,711 A 9/1989 Yuasa
4,867,771 A * 9/1989 Yuasa ..... 439/752
5,947,775 A * 9/1999 Yamamoto et al. ..... 439/752

FOREIGN PATENT DOCUMENTS

GB 2218272 * 11/1989
JP 62-136781 * 6/1987

* cited by examiner

*Primary Examiner*—Gary F. Paumen
(74) *Attorney, Agent, or Firm*—Banner & Witcoff, Ltd.

(57) ABSTRACT

The invention provides a moulded plastic connector in which the mould is not weakened, and in which terminal fittings are not exposed. Portions of a side of a retainer attachment hole 13, which are opposite an insertion hole 14 for a retainer 20, are open to form mould removing holes 15, the remaining portion being covered by a wall 16. This wall 16 reduces the degree to which terminal fittings 19 are exposed from the interior of a housing 10. When a connector C is to be moulded, anterior ends of a first mould 30 (which is removed from the housing 10 via the insertion hole 14) and a second mould 40 (which is removed via the mould removing holes 15) fit together within the retainer attachment hole 13 in a doubled-over manner in a direction which intersects with the direction of mould removal. Consequently, the strength of the moulds 30 and 40 is not decreased.

3 Claims, 5 Drawing Sheets

CONNECTOR AND MOULD

TECHNICAL FIELD

The present invention relates to a moulded electrical connector provided with a retainer, and a mould for manufacture of the connector.

BACKGROUND TO THE INVENTION

A connector is provided with a side retainer for retaining terminal fittings, whereby the terminal fittings are inserted into a housing and the retainer is pushed in to intersect with these terminal fittings.

This type of connector is described in JP 62-136781 and JP 1-197979.

In this connector, if an attachment hole for the retainer is long and narrow or plate-shaped, a mould for forming this retainer attachment hole is also long and narrow or plate-shaped and may be relatively weak. Consequently, measures to strengthen it are required.

One means of strengthening is to provide two moulds which have protruding moulding members whose protruding length is less than the depth of the retainer attachment hole. These protruding moulding members make mutual contact and thereby form one retainer attachment hole. In this case, the two moulds are removed in mutually opposing directions. Consequently, both ends of the retainer attachment hole are open and pass through to outer faces of the housing. Of these two end openings, the opening at the side from which the retainer is pushed in is then covered by the retainer itself The other opening is not covered, and the terminal fittings which are within the housing are exposed therefrom. Exposing the terminal fittings from the opening in this manner is unsightly and foreign objects can also easily penetrate therein from the exterior.

The present invention has taken the above problem into consideration, and aims to present a connector in which the mould is not weakened, and in which the terminal fittings are not exposed.

SUMMARY OF THE INVENTION

According to one aspect of the invention there is provided a mould for moulding a body of an electrical connector, said body having a plurality of parallel terminal insertion cavities, and a retainer insertion cavity intersecting said terminal insertion cavities, said retainer insertion cavity being defined by first and second mould parts extendable towards each other from opposite directions from a disengaged to an engaged condition, the first mould part defining a retainer insertion aperture, a portion of the inner face of the retainer insertion cavity and an inner end wall thereof, and the second mould part defining the remaining portion of the inner face of the retainer insertion cavity and the outer end wall thereof, the first and second mould parts overlapping in the engaged condition.

Such a mould permits shorter and thus stiffer mould parts which can furthermore support each other due to the overlap. The overlap is preferably in the form of an interlock in the direction of the terminal insertion apertures.

According to a second aspect of the invention there is provided a moulded connector body of an electrical connector, said body having a plurality of parallel terminal insertion cavities, and a retainer insertion cavity intersecting said terminal insertion cavities, wherein one end of said retainer insertion cavity is fully open, the other end being partly open, and closed between planes defined by upper and lower edges of said terminal insertion cavities.

Insertion of a retainer in such a connector body can substantially close the necessary moulding apertures at both ends. The retainer is preferably engageable by the body in both temporary and final conditions to permit transport thereof in a partially finished state.

BRIEF DESCRIPTION OF DRAWINGS

Other features of the invention are disclosed in the following description of a preferred embodiment shown by way of example only in the accompanying drawings in which.

DESCRIPTION OF PREFERRED EMBODIMENT

Figure 1:
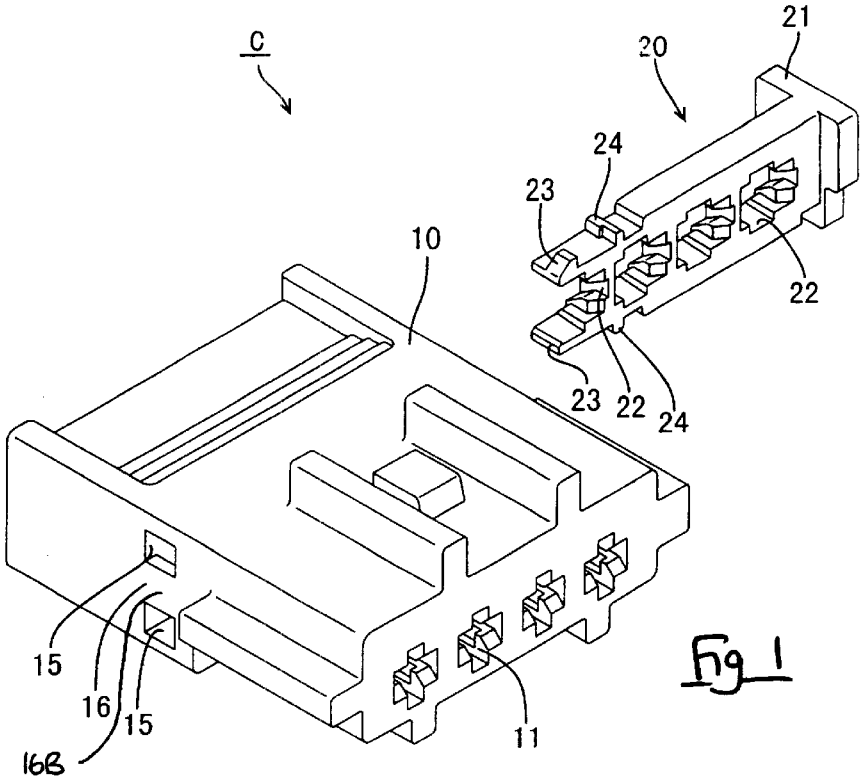
FIG. 1 is a diagonal view of an embodiment of the invention showing a retainer in a separated state from a housing.
Figure 2:
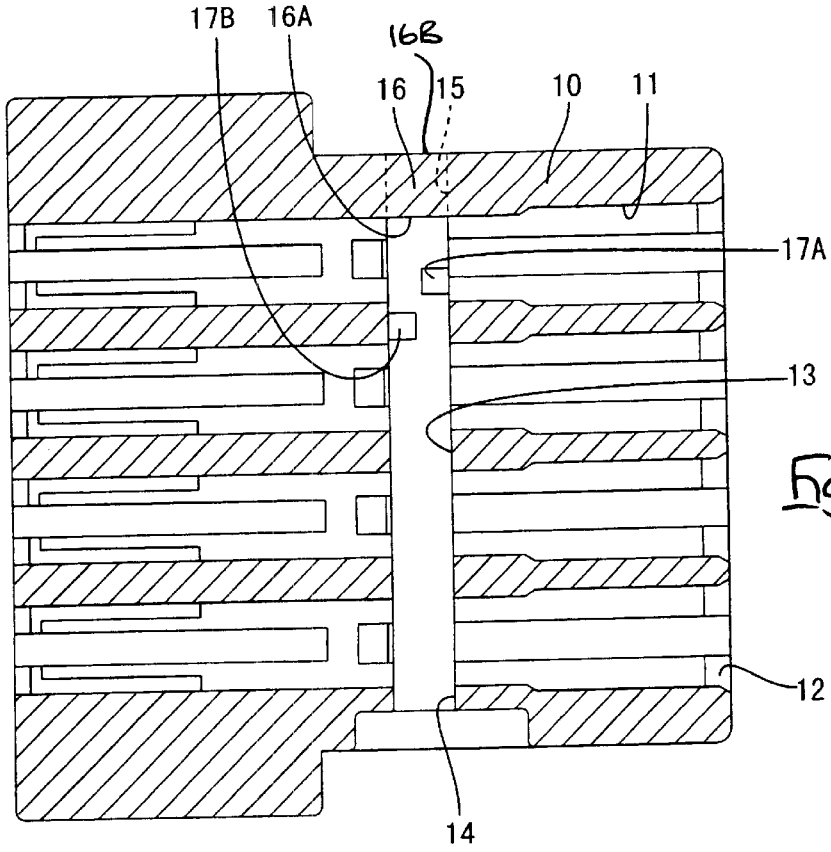
FIG. 2 is a horizontal cross-sectional view of the housing.
Figure 3:
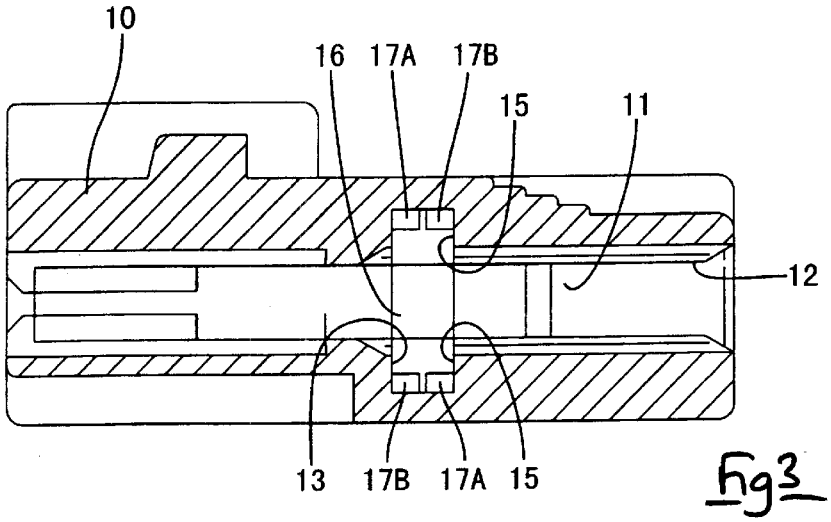
FIG. 3 is a vertical cross-sectional view of the housing.
Figure 4:
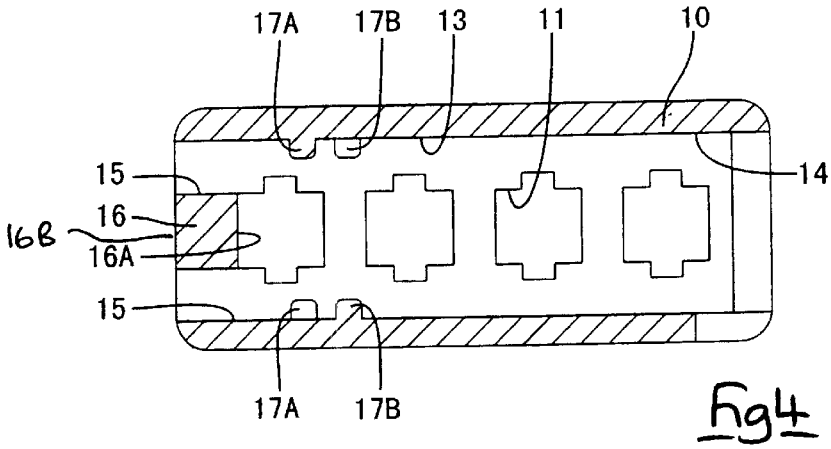
FIG. 4 is a side cross-sectional view of the housing.

An embodiment of the present invention is described below with the aid of FIGS. 1 to 11.

A connector C consists of a plastic housing 10, a plurality of terminal fittings 19 made from metal (although the present embodiment has four terminal fittings, there may be three or less, or five or more), and a plastic retainer 20. Corresponding cavities 11 are formed in a mutually aligned manner within the housing 10, and these cavities 11 open onto anterior and posterior side faces of the housing 10. The openings at the posterior side (the right side in FIGS. 2 and 3) form terminal fitting insertion holes 12 through which the terminal fittings 19 are inserted.

Left and right side faces (upper and lower side faces in FIG. 2, left and right side faces in FIGS. 4 to 6) of the housing 10 have openings therein which form a retainer attachment hole or retainer insertion cavity 13. This retainer attachment hole 13, when seen from a horizontal cross-sectional view, has a long, vertical slit shape. the retainer attachment hole 13 extends in a direction which intersects with the insertion path of the terminal fittings 19 within the housing 10. A right end of the retainer attachment hole 13 forms an insertion hole 14 which is open along the entire horizontal cross-sectional face of the retainer attachment hole 13. The retainer 20 is inserted from this insertion hole 14. The upper one third and the lower one third of a left end of the retainer attachment hole 13 form mould removing holes 15. These mould removing holes 15 open out to the left outer side face of the housing 10. The central one third of the left end of the retained attachment hole 13 is in a covered state and forms an end wall 16.

A pair of receiving protrusions 17A and 17B are formed on an upper face and on a lower face of the retainer attachment hole 13. These receiving protrusions 17A and 17B are spaced apart from one another in the inserting direction of the retainer 20 in the retainer attachment hole 13 (the left-right direction of the housing 10), and are also separated from one another in the anterior-posterior direction of the housing 10. That is, on the upper face, a receiving protrusion 17A (hereafter referred so as the first receiving protrusion 17A) is located at a left anterior side relative to the inserting direction of the retainer 20, and another receiving protrusion 17B (hereafter referred to as the second receiving protrusion 17B) is located at a right posterior side. On the lower face, a receiving protrusion 17A (hereafter referred to as the first receiving protrusion 17A) is located at a right anterior side relative to the inserting direction of the retainer, and another receiving protrusion 17B (hereafter referred to as the second receiving protrusion 17B) is located at a left posterior side.

The retainer 20 is shaped like a thick plate. A pinching member 21 is formed on a base end thereof, and recesses 22 are formed therein in locations which correspond to the cavities 11. An upper and lower pair of stopping members 23 are formed on a anterior end (the end opposite the pinching member 21) of the retainer 20. Stopping protrusions 24 are formed on upper and lower faces thereof at locations close to the stopping members 23.

Figure 5:
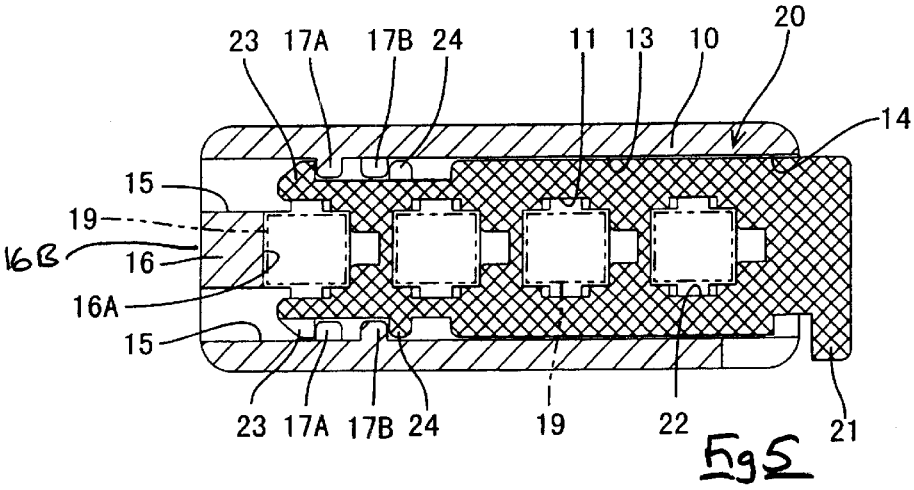
FIG. 5 is a side cross-sectional view of the retainer in a temporarily retained state in the housing.

The retainer 20, which has been inserted into the retained attachment hole 13 from the insertion hole 14, is first maintained in a temporarily retained position. In this state, as shown in FIG. 5, the upper and lower stopping members 23 of the retainer 20 rise over the first and second receiving protrusions 17A and 17B of the retainer attachment hole 13 and are retained, in an anterior direction relative to the direction of insertion, by the first receiving protrusions 17A. By this means, the retainer cannot be moved in the direction of removal. Furthermore, the upper and lower stopping members 23 of the retainer 20 engage with the second receiving protrusions 17B of the retainer attachment hole 13, thereby preventing the retainer 20 from moving in the direction of insertion. That is, the retainer 20 is temporarily retained in a state whereby its movement is regulated in the direction of removal and the direction of insertion. In this state, the recessed members 22 correspond in location to the cavities 11. Consequently, the terminal fittings 19 can be inserted into the cavities 11 without interfering with the retainer 20.

Figure 6:
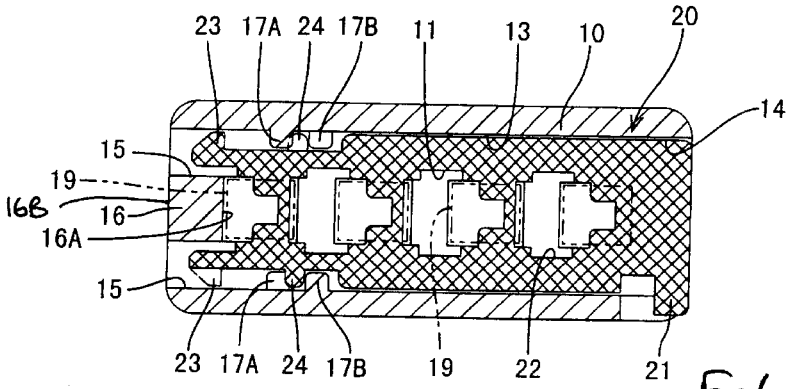
FIG. 6 is a side cross-sectional view of the retainer in a main retaining state in the housing.
Figure 7:
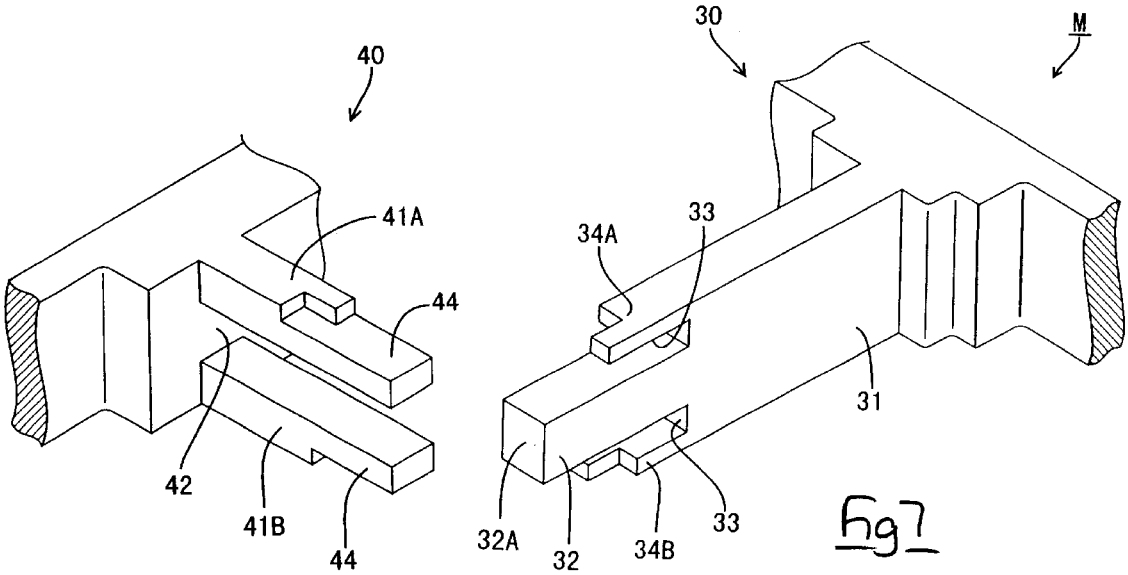
FIG. 7 is a diagonal view of a mould.
Figure 8:
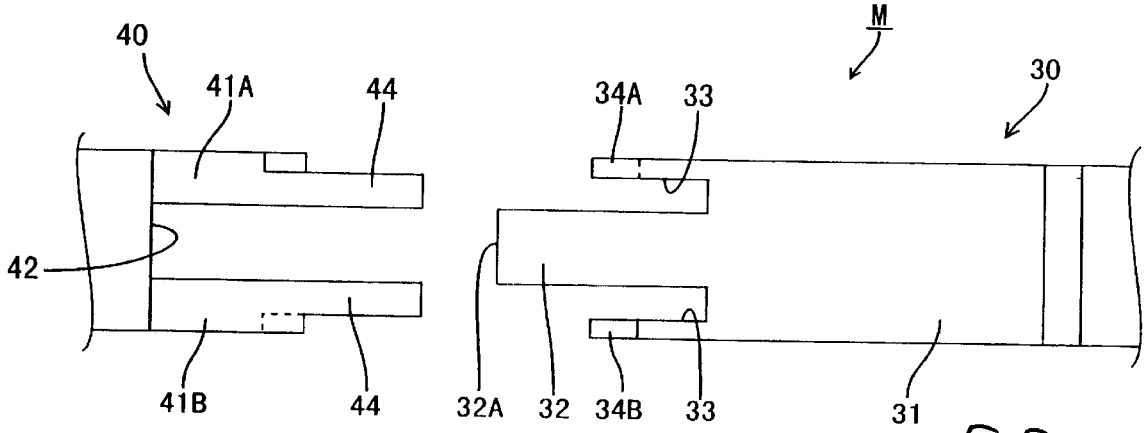
FIG. 8 is a side face view of the mould in an open state.
Figure 9:
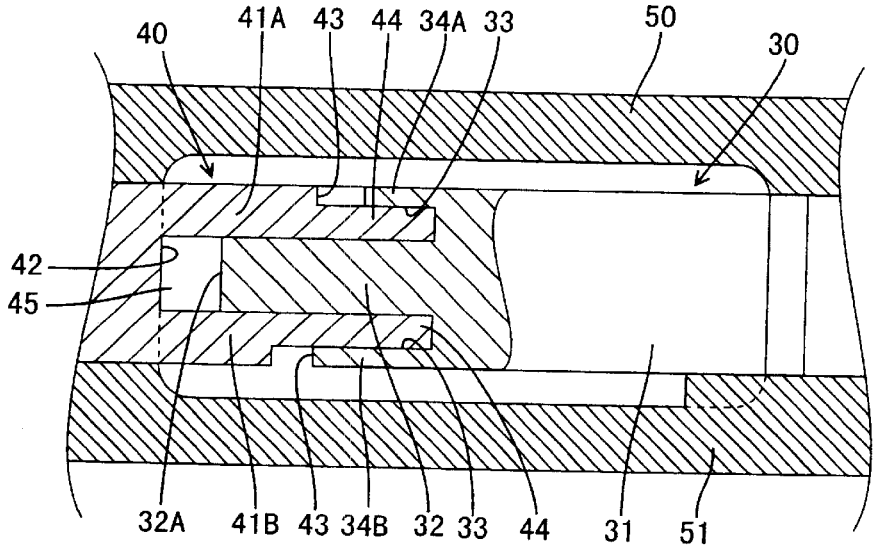
FIG. 9 is a partially cut-away side face view of the mould in a closed state.
Figure 10:
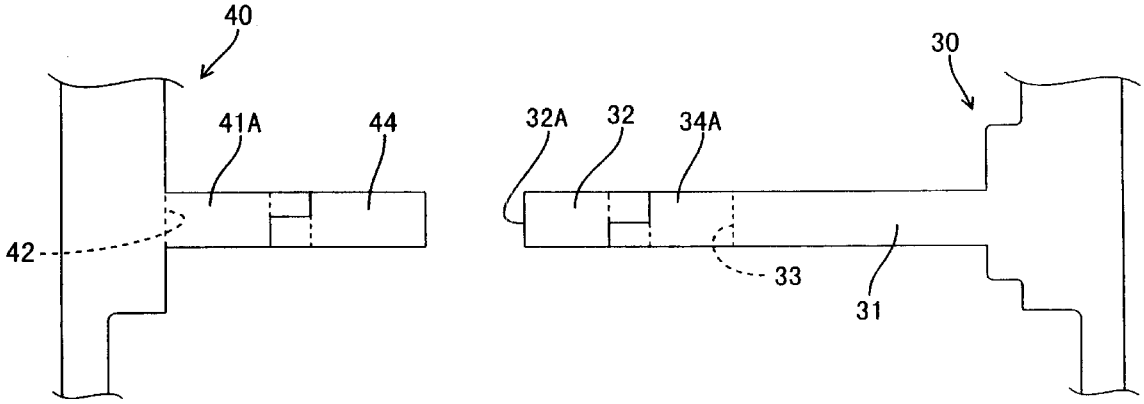
FIG. 10 is a plan view of the mould in the open state.
Figure 11:
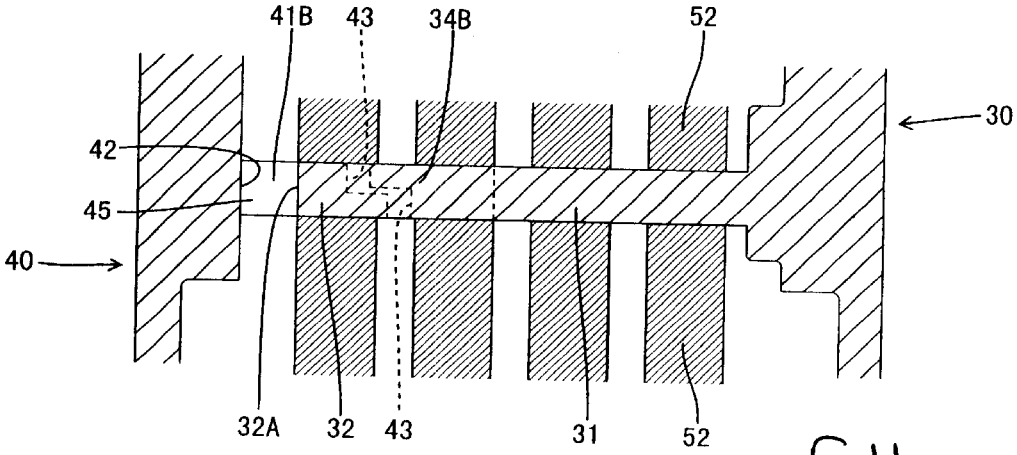
FIG. 11 is a partially cut-away plan view of the mould in the closed state.

If the retainer 20 is pushed deeper inwards from this temporarily retained state, it reaches a main retaining position. In this state, as shown in FIG. 6, the stopping protrusions 24 rise over the second receiving protrusions 17B and are gripped between the first receiving protrusions 17A and the second receiving protrusions 17B, thereby preventing the retainer 20 from moving in the direction of removal and the direction of insertion. In this state, a portion of opening edges of the recessed grooves 22 engage with the terminal fittings 19 (this is not shown), thereby locking the terminal fittings 19 in an unremovable state.

Next, a mould M for forming the connector C is explained with the aid of FIGS. 7 to 11.

The mould M is formed is formed from: a first mould 30 and a second mould 40, these forming the retainer attachment hole 13; an upper mould 50 and a lower mould 51, these forming the upper face and lower face of the housing 10; and a sliding mould 52 for forming the interior of the cavities 11.

The first mould 30 has a main moulding member 31 which protrudes so as to enter the retainer attachment hole 13 from the insertion hole 14. An outer circumference face of the main moulding member 31 forms an area which joins with the insertion hole 14 at an inner circumference face of the retainer attachment hole 13. Further, a protruding member 32 is formed on approximately an upper one third of a protruding end of the main moulding member 31. A protruding end face 32A of the protruding member 32 moulds an inner face 16A (the face in the vicinity of the retainer attachment hole 13) of the wall 16. Side faces of the protruding member 32 mould the inner side faces of the retainer attachment hole 13. An upper and lower of pair of plate-shaped receiving protrusion moulding members 34A and 34B are formed on the protruding end of the main moulding member 31. These receiving protrusion moulding members 34A and 34B are joined to an upper face and a lower face of the main moulding member 31 as unified faces and have spaces 33 between upper and lower faces of the protruding member 32. Protruding end portions of the receiving protrusion moulding members 34A and 34B are step-shaped when seen from above, these steps corresponding to the locations of the first receiving protrusions 17A and the second receiving protrusions 17B. The receiving protrusions moulding 34A and 34B also mould the area from the receiving protrusions 17A and 17B to the insertion hole 14.

The second mould 40 has an upper and lower pair of receiving protrusion moulding members 41A and 41B, and has a wall forming face 42 located between these receiving protrusion moulding members 41A and 41B. This moulds an outer face 16B of the wall 16. when the mould is in a closed state, protruding ends of the receiving protrusion moulding members 41A and 41B oppose the protruding ends of the receiving protrusion moulding members 34A and 34B of the first mould 30, leaving spaces 43 therebetween for forming the receiving protrusions 17A and 17B. Further, and upper face of the upper receiving protrusion moulding member 41A and a lower face of the lower receiving protruding member 41B mould the area from the receiving protrusions 17A and 17B to the mould removing holes 15, and also mould inner faces of the mould removing holes 15. Moreover, strengthening members 44 protrude from the protruding ends of the receiving protrusion moulding members 41A and 41B, these fitting with the spaces 33 formed between the receiving protrusion moulding members 34A and 34B and the protruding member 32.

When the connector C is to be moulded, the moulds 30, 40, 50 and 51 are closed. Then, the strengthening members 44 of the second mould 40 fit into the spaces 33 between the protruding member 32 and the receiving protrusion moulding members 34A and 34B of the first mould 30. Consequently, the protruding ends of the moulds 30 and 40 make close contact and mutually overlap within the retainer attachment hole 13 in a direction which intersects with the removing direction. As a result, there is no danger of change of shape due to injection pressure.

When the mould is in the closed state, the spaces 43 for forming the receiving protrusions 17A and 17B are maintained between the anterior ends of the receiving protrusion moulding members 34A and 34B and 41A and 41B (see FIG. 9,) and a space 45 for forming the wall 16 is maintained between the protruding end face 32A of the protruding member 32 and the wall forming face 32. The connector C is moulded from this state. When the mould is to be opened after moulding has been completed. the first mould 30 is removed to the right of the housing 10 from the insertion hole 14 of the retainer attachment hole 13, and the receiving protrusion moulding members 41A and 41B of the second mould 40 are removed by being pulled from the mould removing holes 15 at the upper and lower portions of the wall 16.

In the present embodiment, the wall 16 is present on the side opposite the insertion hole 14 of the retainer attachment hole 13. Consequently, the terminal fittings 19 are not exposed at the outer face of the housing 10. Moreover, a decrease in the strength of the moulds 30 and 40 is avoided when the connector C is to be moulded by ensuring that the anterior ends of the first mould 30 (which is removed from the housing 10-via the insertion hole 14) and the second mould 30 (which is removed via the mould removing holes 15) fit together in a doubled-over manner in a direction which intersects with the direction of mould removal. That is, the moulds 30 and 40 are strengthened even though the wall 16 opposite the insertion hole 14 of the retainer attachment hole 13 is present.

What is claimed is:

1. A moulded connector body of an electrical connector, said body having a plurality of parallel terminal insertion cavities each for receiving a terminal, and a retainer insertion cavity having a cross section adapted to receive a retainer, the retainer insertion cavity extending through the body so as to define opposite ends and intersecting said terminal insertion cavities whereby the retainer when fully received in the retainer insertion cavity retains the terminals in the terminal insertion cavities, wherein the cross section of said retainer insertion cavity is fully open to the exterior at a first of said ends to receive the retainer, and partly open to the exterior at a second of said ends, the second end being partly closed by an end wall in substantial alignment with the terminal receiving cavities and defined by an inner face and an outer face.

2. A connector body according to claim 1 and having two protrusions extending into said retainer insertion cavity from one side thereof, said protrusions being spaced in the direction of the retainer insertion cavity and not overlapping in the direction of said terminal insertion apertures.

3. A connector body according to claim 2 and having two pairs of said protrusions extending towards each other from opposite sides.

* * * * *